US009340906B2

(12) United States Patent
Zhang et al.

(10) Patent No.: US 9,340,906 B2
(45) Date of Patent: May 17, 2016

(54) METHOD FOR PREPARING HIGH-GRADE AND CASUAL FABRIC WITH SPECIAL LEATHER FEEL USING BIOLOGICALLY CORN-BASED FIBRES

(75) Inventors: Junyan Zhang, Jiangsu (CN); Huirong Lin, Jiangsu (CN); Pei Zhang, Jiangsu (CN)

(73) Assignee: DANYANG DANQI TEXTILE COMPANY LIMITED, Danyang, Jiangsu (CN)

( * ) Notice: Subject to any disclaimer, the term of this patent is extended or adjusted under 35 U.S.C. 154(b) by 359 days.

(21) Appl. No.: 13/983,909

(22) PCT Filed: Oct. 28, 2011

(86) PCT No.: PCT/CN2011/001807

§ 371 (c)(1),
(2), (4) Date: Aug. 6, 2013

(87) PCT Pub. No.: WO2012/151727

PCT Pub. Date: Nov. 15, 2012

(65) Prior Publication Data

US 2013/0312236 A1 Nov. 28, 2013

(30) Foreign Application Priority Data

May 10, 2011 (CN) ..... 2011 1 0119629

(51) Int. Cl.

| | |
|---|---|
| ***D06C 27/00*** | (2006.01) |
| ***D03D 23/00*** | (2006.01) |
| ***D03D 15/00*** | (2006.01) |
| ***D06P 5/24*** | (2006.01) |
| ***D06P 5/28*** | (2006.01) |
| ***D06P 5/30*** | (2006.01) |
| ***D01H 4/02*** | (2006.01) |
| ***D03D 3/00*** | (2006.01) |
| ***D06C 15/00*** | (2006.01) |
| ***D06M 15/00*** | (2006.01) |
| ***D06N 3/00*** | (2006.01) |
| ***D02G 3/02*** | (2006.01) |

(52) U.S. Cl.

CPC ..... *D03D 15/00* (2013.01); *D01H 4/02* (2013.01); *D02G 3/02* (2013.01); *D03D 3/00* (2013.01); *D03D 15/0061* (2013.01); *D06C 15/00* (2013.01); *D06M 15/00* (2013.01); *D06N 3/0006* (2013.01); *D06N 3/007* (2013.01); *D06N 3/0015* (2013.01); *D06N 3/0077* (2013.01); *D06P 5/003* (2013.01); *D06P 5/005* (2013.01); *D06P 5/30* (2013.01); *D06N 2201/04* (2013.01); *D06N 2211/28* (2013.01); *D10B 2331/04* (2013.01); *D10B 2501/00* (2013.01)

(58) Field of Classification Search

CPC . D03D 15/005; D03D 15/0027; D03D 15/00; D03D 15/0061; D06C 15/00; D06C 27/00; D06P 3/82; D06P 3/8204; D06P 5/005; D06P 5/00; D02G 3/02; D02G 1/161; D02J 1/08; D06M 15/00; D01H 4/02; D06N 3/007; D06N 3/0006; D06N 3/0015

USPC ..... 28/271, 165, 166, 167, 169, 178, 179

See application file for complete search history.

(56) References Cited

U.S. PATENT DOCUMENTS

| | | | | |
|---|---|---|---|---|
| 6,561,230 | B1 * | 5/2003 | Ikeda | D02G 3/32 139/420 B |
| 7,132,024 | B2 | 11/2006 | Wang et al. | |
| 7,132,131 | B2 | 11/2006 | Bottger et al. | |
| 2003/0159749 | A1 * | 8/2003 | Hotta | D01F 6/62 139/421 |
| 2004/0011017 | A1 * | 1/2004 | Yuuki | D02G 3/04 57/255 |
| 2007/0031664 | A1 * | 2/2007 | Kuwano | D01F 2/06 428/364 |
| 2010/0047538 | A1 * | 2/2010 | Susa | D02G 3/38 428/196 |
| 2011/0263171 | A1 * | 10/2011 | Bates | D03D 15/00 442/181 |
| 2012/0028528 | A1 * | 2/2012 | Bates | D03D 15/00 442/199 |
| 2013/0005207 | A1 * | 1/2013 | Drysdale | D01F 6/92 442/181 |
| 2013/0209738 | A1 * | 8/2013 | Lee | D06N 3/0011 428/151 |
| 2014/0308865 | A1 * | 10/2014 | Kumar | D03D 15/0027 442/184 |

FOREIGN PATENT DOCUMENTS

| | | | |
|---|---|---|---|
| CN | 1570267 | A | 1/2005 |
| CN | 1793461 | A | 6/2006 |
| CN | 101092776 | A | 12/2007 |
| CN | 101525844 | A | 9/2009 |

* cited by examiner

*Primary Examiner* — Amy Vanatta

(74) *Attorney, Agent, or Firm* — Novick, Kim & Lee, PLLC; Allen Xue

(57) ABSTRACT

A method for preparing high-grade and casual fabric with special leather feel using a corn-based fiber that comprises the steps of: 1) selecting 0.3-0.5 D/PF ultrafine corn-based polymeric fiber, i.e., DuPont™ SORONA®, and 0.2-0.4 D/PF long porous bright polyester yarns as raw materials; 2) compositing by air-jet texturing: having the above raw materials composited by low tension air-jet texturing in an air texturing machine, with the tension force controlled in the range of 4.5-6.0 cN, so as to form ATY yarns with a denier number of 120-180 D; 3) weaving, which includes yarn sizing, preliminary drying, oil applying and plain weaving; 4) dyeing and finishing, which include treating a fabric by pre-treating, presetting, splitting and alkali detaching, water washing and dehydrating, dyeing, water repellent treatment, instant ultra-high temperature treatment, and one-sided lustering.

4 Claims, No Drawings

METHOD FOR PREPARING HIGH-GRADE AND CASUAL FABRIC WITH SPECIAL LEATHER FEEL USING BIOLOGICALLY CORN-BASED FIBRES

TECHNICAL FIELD

The present invention relates to a new, high-grade, anti-wrinkle fabric for casual clothing that has a hand of leather. The method involves air-jet texturing of a 0.3-0.5 D/PF corn-based long fiber, i.e., DuPont™ SORONA®, and the 0.2-0.4 D/PF porous fine denier polyester long fiber and the relevant weaving process, and further involves a finishing process employing an instant ultra-high temperature finishing technology.

BACKGROUND ART

The fast-paced modern life makes the casual clothing high in demand. Being a large category of casual clothing, leather is very popular among consumers. However, as people become more aware of animal protection, the use and supply of fur become limited. Therefore, faux leather fabrics are used to replace real leather.

In general, traditional faux leather fabrics on the market today are divided into PV and PU materials, which use in a gel-coating and scraping process, or a film-coating and laminating process in the finishing step. The disadvantages are obvious: the PV and PU leather production processes generate pollutions such as waste water and gas. Furthermore, such products have long suffered deficiencies such as stiffness, prone to aging, not washable, and not friction resistant. In addition, faux leather fabrics formed by gluing or laminating are prone to separation into layers, or to form air pockets and to peel off, which are less than ideal. It is always the focus of our company to solve the above problems and to produce a faux leather that has characteristics similar to that of natural leather or even surpass natural leather in some aspects (such as being washable, easy to care for, resistant to wrinkle and wear, etc.).

SUMMARY OF THE INVENTION

In response to the shortcomings described above, the objective of this invention is to provide a method of preparation that uses a corn-based fiber to make a high-grade fabric for casual clothing with a special hand of leather. The method starts with compositing by air-jet texturing of the 0.3-0.5 D/PF corn-based fiber, i.e., DuPont™ SORONA®, and the 0.2-0.4 D/PF porous fine denier polyester fiber. It improves the fabric sizing process during weaving, and, after dyeing, uses an instant ultra-high temperature finishing technology in the finishing step. The method also involves making the fabric water repellent as well as calendering of one side of the fabric.

The technical scheme of the present invention is realized by: a method of preparation for a corn-based high grade fabric for casual clothing that has a special hand of leather, comprises the following steps: 1) selecting raw materials; 2) compositing by air-jet texturing; 3) weaving; 4) dyeing and finishing; characterized in that:

1) selecting raw materials: selecting as the raw material a corn-based 0.3-0.5 D/PF ultrafine fiber, i.e., DuPont™ SORONA®, and the 0.2-0.4 D/PF porous fine denier polyester bright long fiber;

2) compositing by air-jet texturing: conducting low-tension compositing of the above-mentioned two raw materials on a compositing machine, controlling the tension at 4.5-6.0 CN. Two long fibers, after drawing and hot stretch, pass through the air nozzle and are entwined by the air jet, forming the air textured yarn (ATY) withdenier 120-180 D;

Said drawing and heat stretching temperature is controlled at 110-125° C., stretching ratio is controlled at 1.2-1.5, and water supplying rate is 0.6-0.8 L/h;

3) Weaving:

(1) yarn sizing: sizing in a drying drum-type sizing machine, applying strict control on the feed tension and the winding tension. The feed tension is controlled at 60-65 mN and the winding tension is controlled at 65-70 mN. High pressure sizing is used. The sizing agent is of high concentration and low viscosity. The slurry concentration is 10-11%. The sizing agent slurry has a pressure of 1.6-1.8 cN. The soaking pressure is 2.1-2.3 cN;

(2) pre-drying: after sizing the ATY yarn is fed into the drying room for a multiple level, segmented pre-drying. After exiting the drying room, the yarn enters into the drying cylinder. The cylinder temperature is medium to low, and is also adjusted from higher to lower temperatures, so that the slurry completely penetrates into the yarn interior. At the same time, a size film is formed on the surface of the yarn, which is resilient and friction resistant.

The parameters in the multiple level, segmented pre-drying process are: the first drying room temperature: 136-138° C., the second drying room temperature: 130-132° C., the first cylinder temperature: 98-100° C., the second and third cylinder temperature: 93-95° C., the fourth and fifth cylinder temperature: 90-92° C.; elongation: +0.1-0.2%, sizing rate: 4.8-5.2%, speed: 110-120 m/min;

(3) oiling: After drying, applying 1% oil or an anti-static agent to the fiber;

(4) weaving: the weaving speed 520-550 rpm/min, plain weave.

4) dyeing and finishing:

(1) first the fabric is pre-treating by refining and relaxation-one bath at temperature of 110-120° C. for 30 minutes.

(2) pre-setting: temperature controlled at 70-80° C., 40 seconds, (3) alkali detaching weight reduction: liquid ratio of 1:18, the temperature 120° C., 45 min, alkali reduction rate of 11-12%.

(4) washing, drying, neutralizing the fabric with a small amount of acid to reach a pH value of 6-7, 15-20 minutes.

(5) dyeing: temperature 115° C., time 45 minutes, pH value=5, liquid ratio of 1:40, the initial temperature in the tank is 40-50° C., which is raised at a rate of 1-1.5° C./min to 80° C., maintaining the temperature for 8 minutes, then raising the temperature at a rate of 0.5-0.8° C./min to 115° C. After dyeing, the temperature is lowered to 80° C., reduction cleaning 15-20 minutes, in which the reducing cleaning agent 2.5 g/L, using acetic acid solution to neutralize the pH.

(6) water repellent treatment: resin treatment, speed 40-50 m/min.

(7) instant ultra-high temperature finishing: finishing on a finishing machine at a temperature of 200-230° C., pressure: 40-60 T, speed: 80-100 m/min.

(8) calendering of one side: using the differences in the speed and hardness of the upper and lower rollers of a calender to polish one side of the fabric. (temperature: 130-160° C., speed: 25-30 m/min) so that the fabric is soft but full, and using methods other than coating, scraping gel, compositing, and laminating to form a surface texture of leather.

The fabric produced using the method of the present invention is wrinkle resistant and has the hand of leather. It has a smooth surface, a soft touch, and a rich texture. It is water repellent, resistant to static, stain, and wrinkle. It has the natural luster and texture of leather. It is breathable and moisture permeable. It can be used to make a coat, jacket, padded fall and winter clothes. One can also use it to make spring and summer clothing such as suit jackets, blazers, and light jackets. The fabric can be washed in water or dry-cleaned. It is iron-free and easy to take care of.

DESCRIPTION OF THE EMBODIMENTS

The method for making a new wrinkle-resistant fabric for casual clothing with the feel of leather mainly include the following steps:

1. selecting raw materials: 75D/188F superfine corn-based fiber, i.e., DuPont™ SORONA®, which is a corn-based polymeric fiber. It has a low modulus and is highly recoverable so that it has a strong deformation capacity and anti-wrinkle capacity. The porous 50D/166F fine denier polyester yarn is also a raw material.

2. compositing by air-jet texturing: the two fibers are composited on a Japanese-made B-501ATY air-jet texturing machine. The two long fibers are drawn through the air nozzle and entwined by air jets. This yarn has a high bulk, three-dimensional structure. Its hand and appearance are close to the staple fiber yarn but has less fine hair. It has a good pilling resistance and is strong. Its actual denier measures at 135 D after compositing. One should pay attention to the following issues during the air-jet texturing:

a) since two fibers are both ultra-fine, porous materials, tensions in various zones during the air texturing process greatly affect the resultant yarn. The tension is low in the deforming zone so that it is easy to deform and form loops. The tension is relative low in the stabilizing zone, which reduces the internal tension of the yarn and reduces the generation of fine hairs. In the present example, the tension is controlled at 4.5-6.0 cN.

b) the overfeed rate of the fiber affect the volume of the yarn. Too low an overfeed rate negatively affects the loop formation. The resultant yarn is too loose, has a lower strength, and its linear density increases. The present example controls the overfeed rate at 8-15%.

c) in the present example, the heat drawing temperature is controlled at 110-125° C., the stretching ratio is controlled at 1.2-1.5. The water supply rate is controlled at 0.6-0.8 L/h.

3. weaving: prior to weaving, the sizing process has been greatly improved so that the semi-finished product has a better quality, which benefits the weaving process. This ATY yarn is quite special and is sized using a FS-Z800 drying drum-type sizing machine.

1) sizing: the feed tension and the winding tension of the sizing machine are strictly controlled. Taking full advantages of the low tension of the imported sizing machine, the feed tension is controlled at 60-65 mN and the winding tension is controlled at about 65-70 mN per yarn. High-pressure sizing is used. The agent has a high concentration and a low viscosity. The concentration adjusted to 10-11%. The slurry pressure is 1.6-1.8 cN and the soaking pressure is 2.1-2.3 cN. The ATY yarn, after coming out from the slurry tank, enters the drying section that employs a multiple level segmented pre-drying. When the yarn comes out from the drying room and enters the drying cylinder, the cylinder temperature is medium to low, and the temperature is controlled from higher to lower so that the liquid slurry can fully penetrate into the internal surface of the yarn. At the same time, the sizing agent forms an resilient and friction-resistant film. The multiple level, segmented pre-drying process has the following parameters: the first drying room temperature: 136-138° C., the second drying room temperature: 130-132° C., the first cylinder temperature: 98-100° C., the second and third cylinder temperature: 93-95° C., the fourth and fifth cylinder temperature: 90-92° C. elongation: +0.1-0.2%, the size pick-up rate: 4.8-5.2%, speed: 110-120 m/min. After the sizing and the drying, 1% of the oil or antistatic agents is applied to the yarn. It can smooth over the surface of the yarn, lowering the friction coefficient, and also make it anti-static.

2) Weaving: Name: WT061YT; weave structure: plain.

Raw materials: vertical thread A: 135 DATY fiber (SORONA®/polyester bright fiber two-component 8844 fibers) vertical thread B: BELLTAON9RB-75 conductive fibers 176 fibers, A: B=50:1

Horizontal thread: 75 D/144FDTY bright fiber, density: 136X71 Width: 168 cm

Weaving machine model: Japanese-made, LW551 multiple arm loom; weaving speed: 520 rpm 4. dyeing, finishing:

1) fabric refining, relaxation—one bath, temperature 110° C., 30 min.

2) the pre-setting temperature controlled at 70-80° C., 40 seconds.

3) alkali detaching weight reduction, bath ratio 1:18, temperature 120° C., 45 min, alkali reduction rate of 11-12%.

4) washing, drying, neutralizing the fabric with a small amount of acid to make a pH value of 6-7, 15-20 minutes.

5) staining: temperature 115° C., time 45 minutes, pH=5, bath ratio 1:40, initial temperature of the tank is 40-50° C., then raise the temperature at a rate of 1-1.5° C. to 80° C., maintain the temperature for 8 minutes, then raise the temperature at a rate of 0.5-0.8° C. to 115° C. After staining, the temperature is lowered to 80° C. Reducing cleaning 15-20 minutes, wherein the reducing cleaning agent is 2.5 g/L, and acetic acid solution is used to neutralize the pH value.

6) water repellent treatment: resin treatment, speed 40-50 m/min.

7) instant ultra-high temperature finishing: the Kusters II type finishing machines imported from Germany is used to apply the instant ultra-high temperature finishing at a temperature of 200-230° C., pressure: 40-60 T, speed: 80-100 m/min.

8) calendering one side of the fabric using an imported calendar, the differences in the mechanical speed and hardness of the upper and lower rollers impart on the fabric surface a lasting soft sheen. It makes the fabric more adaptable and easier to care than real leather. Temperature: 130-160° C., speed: 25-30 m/min.

Water repellent treatment and one-sided calendering make the fabric more adaptable and easier to care than real leather. This overcomes the shortcomings of this type of fabric and reduces pollution and the adhesion of toxic materials on the fabric as well, which is consistent with the trend of environmental protection. It also maximizes the use of renewable raw materials in the fabric selection, which can be mass produced and reduce production costs as much as possible. The embodiment of present invention first involves using 0.3-0.5 D/PF corn-based ultrafine fiber, i.e., DuPont™ SORONA®, and 0.2-0.4 D/PF porous fine denier polyester bright fiber as raw materials. Fine denier fibers have small diameters and low bending stiffness. The fabric is soft and refined. At the same time, in the fine denier fiber, there are small pores to form small air chambers among the micro fibers. The capillary effect increases, which leads to the good performance of permeation of moisture. The fabric has good air permeability and moisture permeability.

Embodiments of the present invention involve air-jet texturing of two fine denier fibers to form the ATY yarn. The ATY has a high volume and a three dimensional structure. Furthermore, the ATY yarn retains more air so that the softness and breathability are further improved.

The third aspect of embodiments of the present invention involves instant ultra-high temperature treatment after dyeing. It utilizes the differences in the shrinkages of various polyester fibers, under the condition of high tension created by the instant high temperature, imparting on the fabric certain mechanical pressure, so that molecular chains at the surface of different polyester fibers rearrange irregularly, creating a texture that resembles natural leather. It forms a "surface-core" layered structure in the single-layer fabric. The core layer retains the softness and absorbency of superfine fiber, similar to pores in natural leather.

The fabric goes through water repellent and calendering treatments in the dyeing and finishing process. The resultant fabric is more adaptable and easy to care.

The corn-based fiber, i.e., DuPont™ SORONA®, has a low modulus and is highly recoverable. The addition of this material makes the fabric highly deformable and wrinkle resistant.

Adding a fiber that has a high electric conductivity in the vertical direction during weaving can effectively and timely deliver charges to the environment so that electric charges do not build up, accomplishing anti-static function. The conductive fiber adopts the newly developed BELLTRON® 9R series composite fiber by Kanebo (Japan). This fiber has an excellent antistatic ability, good washability, good bending resistance, and good friction resistance.

What is claimed is:

1. A method for preparing a corn-based high grade fabric for casual clothing that has a special hand of leather, comprises the following steps: 1) selecting raw materials; 2) compositing by air-jet texturing; 3) weaving; and 4) dyeing and finishing wherein the step of selecting raw materials comprises selecting as the raw materials a 0.3-0.5 D/PF corn-based polymeric fiber and a 0.2-0.4 D/PF polyester fiber;

wherein the step of compositing by air-jet texturing comprises drawing and stretching the corn-based polymeric fiber and the polyester fiber at a tension of 4.5-6.0 cN; and passing the two fibers through an air nozzle so that the two fibers are entwined to form an air textured yarn with a denier of 120-180 D, wherein a step of yarn sizing comprises:

(1) sizing the air textured yarn in a sizing machine at a feed tension of 60-65 mN and a winding tension of 65-70 mN using a sizing slurry of 10-11% in concentration and a pressure of 1.6-1.8 cN at a soaking pressure of 2.1-2.3 cN;

(2) feeding the air textured yarn obtained from the sizing step for pre-drying in one or more drying rooms and cylinder-drying the pre-dried air textured yarn in one or more drying cylinders so that the sizing slurry penetrates into the yarn interior and forming a size film on the surface of the air textured yarn;

(3) applying 1% oil or an anti-static agent to the air textured yarn; and (4) weaving the oiled air textured yarn at a weaving speed of 520-550 rpm/min to obtain a plain weaved fabric, wherein the step of dyeing and finishing comprises:

(1) pre-treating the fabric in a bath at temperature of 110-120° C. for 30 minutes;

(2) pre-setting the fabric at a temperature of 70-80° C. for 40 seconds;

(3) treating the fabric in an alkali bath at a liquid ratio of 1:18 at a temperature of 120° C. for 45 min to achieve an alkali reduction rate of 11-12%;

(4) washing, drying, neutralizing the fabric to a pH value of 6-7;

(5) dyeing the fabric with a dyeing agent at a pH value of 5 and a liquid ratio of 1:40, wherein the dyeing agent has a temperature initially at 40-50° C., raised at a rate of 1-1.5° C./min to 80° C., maintained at 80° C. for 8 minutes, raised again at a rate of 0.5-0.8° C./min to 115° C., and maintained at 115° C. for 45 minutes, before being lowered to 80° C.; cleaning the fabric for 15-20 minutes using a reducing cleaning agent at 2.5 g/L; and neutralizing the fabric using acetic acid;

(6) treating the fabric using a resin water repellent at a speed of 40-50 m/min;

(7) finishing the fabric on a finishing machine at a temperature of 200-230° C. at a pressure of 40-60 T and a speed: 80-100 m/min; and (8) calendering of one side of the fabric between a pair of rollers at a temperature of 130-160° C. and a speed of 25-30 m/min.

2. The method of claim 1, wherein in the step of compositing by air-jet texturing, said drawing and stretching temperature is carried out at 110-125° C., a stretching ratio of 1.2-1.5, and a water supplying rate of 0.6-0.8 L/h.

3. The method for of claim 1, wherein in the step of yarn sizing, the pre-drying is carried out in a first drying room in a temperature range of 136-138° C., and a second drying room: in a temperature range of 130-132° C., and further drying is carried out in five cylinders, where the first cylinder is in a temperature range of 98-100° C., the second and third cylinder are in a temperature range of 93-95° C., the fourth and fifth cylinder are in a temperature range of 90-92° C.

4. The method of claim 1, wherein the step of finishing the fabric on the finishing machine is carried out at a temperature of 200-230° C., a pressure of 40-60 T, and a speed of 80-100 m/min.

* * * * *